US005803187A

United States Patent [19]

Javins

[11] Patent Number: 5,803,187

[45] Date of Patent: Sep. 8, 1998

[54] ROTARY-PERCUSSION DRILL APPARATUS AND METHOD

[76] Inventor: Brooks H. Javins, 292 Webster Ave., Morgantown, W. Va. 26505

[21] Appl. No.: 701,975

[22] Filed: Aug. 23, 1996

[51] Int. Cl.[6] ..... F21B 10/36

[52] U.S. Cl. ..... 175/57; 175/296; 175/393; 175/415

[58] Field of Search ..... 125/296, 297, 125/415, 418, 393, 424

[56] References Cited

U.S. PATENT DOCUMENTS

| | | | |
|---|---|---|---|
| 2,218,130 | 10/1940 | Court | 15/104.12 |
| 2,783,971 | 3/1957 | Carle et al. | 255/4 |
| 3,576,222 | 4/1971 | Acheson et al. | 175/67 |
| 4,273,201 | 6/1981 | Garrett | 175/107 |
| 4,406,332 | 9/1983 | Dismukes | 175/107 |
| 4,739,845 | 4/1988 | Dennis | 175/393 |
| 4,911,729 | 3/1990 | Rooker | 175/393 |
| 4,958,691 | 9/1990 | Hipp | 175/296 |
| 5,029,657 | 7/1991 | Mahar et al. | 175/393 |
| 5,305,837 | 4/1994 | Johns | 175/61 |
| 5,305,838 | 4/1994 | Pauc | 175/73 |
| 5,322,136 | 6/1994 | Bui et al. | 175/65 |
| 5,435,402 | 7/1995 | Ziegenfuss | 175/414 |

OTHER PUBLICATIONS

Mildren, D., et al., *Know Your Hammer, A DTH Drilling Perspective,* Sandvik Rock Tools, Inc., pp. 1–16 (1991).

*Primary Examiner*—William P. Neuder

*Attorney, Agent, or Firm*—Kirk D. Houser; Arnold B. Silverman; Eckert Seamans Cherin & Mellott, LLC

[57] ABSTRACT

A down-hole pneumatic rotary-percussion hammer drilling apparatus is disclosed. The apparatus includes a drill string for progressively extending into a hole in the earth; an elongated housing connected to the drill string; an impact drill bit, rotationally coupled to the housing, having an engaging surface, an earth impacting surface, a channel, and a plurality of conduits extending from about an exit of the channel to an exit portion of the conduits; a piston within the housing for engaging the engaging surface; and a working fluid handler for energizing the piston with a working fluid. The impact drill bit is rotatable about a longitudinal axis, with the channel and the conduits providing a path of flow of the working fluid from the piston to the exit portions of the conduits. The exit portions are displaced from the longitudinal axis and extend generally downwardly and outwardly. The working fluid emerges from the exit portions and effects rotation of the impact drill bit about the longitudinal axis. Associated method and impact drill bit apparatus are also disclosed.

24 Claims, 11 Drawing Sheets

ROTARY-PERCUSSION DRILL APPARATUS AND METHOD

BACKGROUND OF THE INVENTION

1. Field of the Invention

The present invention relates to an apparatus and method for drilling and, more specifically, it relates to an apparatus and method for rotary-percussion drilling into the earth. The invention also relates to a drill bit for a rotary-percussion drilling apparatus.

2. Description of the Prior Art

The term "drilling" includes, for example, rotary drilling (e.g., penetration by an abrasive action, such as the rotary motion of a drill bit); core drilling (e.g., rotary drilling of an annular groove to leave a central core); percussion drilling (e.g., penetration by a drill bit in a linear motion); rotary-percussion drilling (e.g., any combination of rotary and linear motions to produce penetration); fusion piercing (e.g., penetration by flaking and/or melting caused by the application of heat); and drilling by any variety and/or combination of drilling methods to remove material and form a hole, such as by a rotary motion and two linear motions (e.g., control and hoisting), or by discharging streams of drilling fluid.

A wide variety of reasons for drilling into the earth include, for example, creating transportation tunnels, prospecting and/or acquiring natural resources, and routing cables Such as electrical or fiber optic cables. Many boring or drilling operations require the steering of a drill bit toward a destination and/or away from obstacles, thereby producing curved or nonlinear holes in the earth. Steering a drill line, or drillhole deflection, is a process facilitated by a variety of techniques, such as down-hole wedges, motors and cams. In contrast, drillhole deviation is the change from the desired drillhole path to the actual drillhole path caused by anomalies in the material structure of the earth or by other problems in the drilling procedure.

It is known, in connection with percussion hammer drills, to employ a working fluid, such as a compressed gas, through one or more flush holes in the face or earth impacting surface of the drill bit. The working fluid removes crushed material and brings it back to the surface through passages at the side of the drill bit. See, generally, *Know Your Hammer, A DTH Drilling Perspective*, Sandvik Rock Tools, Inc., pp. 1–16 (1991).

It is also known to employ water in a mud hammer to remove crushed material and bring it back to the surface through passages at the side of a mud hammer drill bit.

It has been known with prior art hydraulic jet drill bits to employ a plurality of nozzles sloped downwardly through the lower end of the drill bit. The drill bit is rotatably mounted on the lower end of the drill string to rotate independently therefrom. The nozzles are directed at an angle having a horizontal component opposite the drill bit's direction of rotation. The reaction from a high-velocity, high-pressure stream of drilling liquid through the nozzles causes rotation of the drill bit at a rate in the range of 500 to 2,000 RPM. See generally, U.S. Pat. No. 3,576,222.

It has been known with prior art well drilling collars forming a part of a rotary drill string to discharge drilling fluid through a pair of horizontal non-radially oriented passages above the drill bit to augment rotation of the drilling collar and, presumably also, the drill string. See, generally, U.S. Pat. No. 4,273,201.

It has further been known with prior art rotary drill bits to employ nozzle bodies with nozzles for discharging streams of drilling fluid. Each of the nozzle bodies includes a plurality of nozzle passageways. The drilling fluid exits from each of the nozzle passageways with a longitudinal component and a tangential component to rotate the nozzle body about its longitudinal axis. See, generally, U.S. Pat. No. 4,739,845.

It has also been known with prior art rotary drill bits to utilize pressurized air to rotate the drill bit by an air motor located near the lower portion of the drilling unit adjacent the drill bit. The drill bit includes passageways for clearing the face of cutter cones and, also, for cooling air motor bearings and drill bit bearings with partially expanded exhaust gas from the air motor. See, generally, U.S. Pat. No. 2,783,971.

It has further been known, with prior art nozzle heads used in the removal of solids, like coke, from vessels, to employ curved conduits with nozzles for discharging horizontal jets of water. The water is discharged tangentially with respect to the axis of rotation of the nozzle head and in a direction perpendicular to the face of cutting blades, either upwardly, horizontally or downwardly, to impart a turning force to the rotor. See, generally, U.S. Pat. No. 2,218,130.

Conventional down-hole pneumatic percussion hammer drills crush earth, such as rock, with an impact drill bit and then remove the particulates via a working fluid such as a stream of compressed gas. The compressed gas provides potential energy for accelerating a hammer piston. As the piston accelerates, the potential energy of the compressed gas is converted to kinetic energy in the form of piston momentum. When the piston engages the impact drill bit, the piston transmits the kinetic energy in the form of an energy wave which passes through the drill bit and into the face of the earth.

Conventional pneumatic percussion hammer drill bits are rotated by rotating the entire drill string or rod (i.e., the entire pipe structure connecting the drill bit to the above-ground rotational power source). Tile impact drill bit has a shank which is splined to the chuck of the pneumatic percussion hammer drill. In this manner, the drill string, drill housing, drill chuck and impact drill bit rotate together as a unit.

In a percussion mode of operation, the hammer piston engages the drill bit which impacts the earth and penetrates a portion of the earth in the hole. In a rotary mode of operation, the drill bit is rotated by the drill string to engage different earth areas with each impact of the hammer piston. Contrasted with systems which cut or shear the earth, the purpose of the rotation of the drill bit in the rotary mode is to reposition the drill bit on the earth face being cut. In this manner, the drill bit rotation maximizes the crushing of the earth and minimizes the possibility of the bit being stuck in a natural or impact-created earth fracture.

The rotating drill string does not present a problem for a hole which goes straight down into the earth. On the other hand, for a curved or nonlinear hole, the drill string typically contacts the walls of the hole. This causes the drill string to creep and rub on the walls, which typically causes the drill line to deviate from its desired direction.

Although a down-hole rotator (e.g., an air motor) may possibly be employed to address this problem by eliminating the rotation of an upper portion of the drill string, it is believed that there is still a rotational reaction between the lower portion of the drill string and the drill bit (e.g., caused by friction), thereby causing the drill string to twist and, hence, hinder precise drilling. It is further believed that the down-hole rotator may potentially malfunction during a drilling operation, thereby reducing the reliability of the drilling system.

U.S. Pat. No. 5,305,838 discloses articulated elements for drilling of a well of a curved trajectory. A lower element is assembled on an upper element by a ball joint. A drill bit is threadably attached to the lower element and a downhole motor is threadably attached to the upper element which, in turn, is followed by the articulated elements, drill collars and drill pipes to the surface.

U.S. Pat. Nos. 5,305,837 and 5,322,136 disclose an air percussion drilling assembly including a drill string, a housing, a piston, a mechanical clutch mechanism, and a hammer drill bit. The piston has helical grooves which are keyed to an inner race of the clutch mechanism by balls or dowel pins. The clutch mechanism allows rotation of the reciprocating piston in one direction on the downstroke thereof. On the upstroke, the piston travels up the housing without rotation. The hammer drill bit is slidably keyed to the bottom of the piston to transfer impact energy to the bottom of a borehole. The drill bit rotates during operation independent of the drill string.

For these reasons, there remains a very real and substantial need for a simplified apparatus and method which improve drillhole deflection in earth structures. In particular, there is a very real and substantial need for a reliable rotary-percussion drilling apparatus and method which improve drillhole deflection in hard earth structures.

SUMMARY OF THE INVENTION

The present invention has met this need by providing a rotary-percussion drilling apparatus for drilling a hole in the earth. The apparatus includes drill string means for progressively extending into the hole; an elongated housing connected to the drill string means; impact drill bit means, rotationally coupled to the elongated housing, having an engaging surface, an earth impacting surface, channel means, and a plurality of conduits each of which extends from about an exit of the channel means to an exit portion of the conduits; piston means within the elongated housing for engaging the engaging surface of the impact drill bit means; and working fluid handling means for energizing the piston means by means of a working fluid. The impact drill bit means is rotatable about a longitudinal axis of the elongated housing, with the channel means and the conduits of the impact drill bit means providing a path of flow of the working fluid from the piston means to the exit portions of the conduits, and the exit portions of the conduits being displaced from the longitudinal axis and extending generally downwardly and outwardly, in order that the working fluid emerging from the exit portions effects rotation of the impact drill bit means about the longitudinal axis of the elongated housing.

A number of preferred refinements include positioning the exit portions of the conduits at about the earth impacting surface in order to effect lift and rotation of the impact drill bit means. Also, a plurality of external return passageways on an outer surface of the impact drill bit means may be provided for return therethrough of the working fluid from the earth impacting surface. Preferably, the external return passageways extend at least partially circumferentially and generally upwardly, in order that the return of the working fluid effects rotation of the impact drill bit means. Also, the impact drill bit means may have an intermediate surface between the outer surface and the earth impacting surface, with each of the conduits substantially exiting at the intermediate surface.

The present invention also provides an impact drill bit for use with a rotary-percussion drilling apparatus for drilling a hole in the earth. The apparatus includes drill string means for progressively extending into the hole, an elongated housing being connected to the drill string means, piston means within the elongated housing for engaging the impact drill bit, and means for energizing the piston means by means of a working fluid. The impact drill bit includes an engaging surface; an earth impacting surface; channel means; a plurality of conduits each of which extends from about an exit of the channel means to an exit portion of the conduits; and means for rotationally coupling the impact drill bit to the elongated housing. The channel means and the conduits of the impact drill bit provide a path of flow of the working fluid from the piston means to the exit portions of the conduits, with the impact drill bit rotatable about the longitudinal axis of the elongated housing, and the exit portions of the conduits being displaced from the longitudinal axis and extending generally downwardly and outwardly, in order that the working fluid emerging from the exit portions effects rotation of the impact drill bit about the longitudinal axis of the elongated housing.

The present invention further provides a method for drilling a hole in the earth including the steps of progressively extending a drill string into the hole; employing an elongated housing having a longitudinal axis; connecting the elongated housing to the drill string; employing an impact drill bit having an engaging surface, an earth impacting surface, channel means, and a plurality of conduits; rotationally coupling the impact drill bit to the elongated housing; extending each of the conduits from about an exit of the channel means to an exit portion of the conduits, with the exit portions of the conduits being displaced from the longitudinal axis of the elongated housing; energizing piston means by means of a working fluid and engaging the engaging surface of the impact drill bit with the piston means; providing a path of flow of the working fluid from the piston means to the exit portions of the conduits; and delivering the working fluid outwardly through the exit portions of the conduits in a generally downward direction, in order to cause the working fluid emerging from the exit portions to effect rotation of the impact drill bit means about the longitudinal axis of the elongated housing.

It is an object of the present invention to maintain a drill string generally non-rotating with the rotation of a drill bit.

It is a more particular object of the present invention to provide a rotational force at the drill bit to rotate the drill bit.

It is another more particular object of the present invention to generally isolate rotational forces from the drill string.

It is a still more particular object of the present invention to reduce reaction forces between the drill string and the drill bit caused by friction.

It is also an object of the present invention to provide a drilling apparatus and method which minimize changes to conventional drilling equipment and procedures.

These and other objects of the invention will be more fully understood from the following detailed description of the invention on reference to the illustrations appended hereto.

DESCRIPTION OF THE PREFERRED EMBODIMENTS

As employed herein, the term "rotary-percussion drilling" shall expressly include, but not be limited to rotary drilling (e.g., penetration of the material being drilled by a drill bit in a rotary motion); percussion drilling (e.g., penetration of the material being drilled by a drill bit in a linear motion); and any combination of rotary and linear motions to produce penetration.

As employed herein, the term "working fluid" shall expressly include, but not be limited to any gas (e., air, compressed gas, drilling gas, steam), any liquid (e.g., water, drilling fluid, hydraulic fluid), or any combination thereof employed to effect rotation of a drill bit and/or energize a piston, such as a hammer piston.

As employed herein, the term "earth" shall expressly include, but not be limited to the planet earth, its land masses, river beds, lake beds, sea beds, and ocean beds, including all natural and/or man-made materials found therein (e.g., rock, boulders, lava, glacial till, ground, mud, ice, gravel, sand, silt, clay, soil, concrete, brick, other building materials, or any combination thereof).

As employed herein, for convenience in terms of the frame of reference, the terms "upper", "upwardly", "lower", "downwardly", "vertical", "longitudinal" and "horizontal" are with respect to an elongated drill line normal to the surface of the earth, although the invention is applicable to linear, curved and other nonlinear drill lines which in their entirety, or in portions thereof, are not normal to the earth's surface.

For example, for convenience of reference, the "upper" portion of a drill line is generally closer to the earth's surface than the "lower" portion which generally extends "downwardly" into the earth, and a "vertical" drill line and the "longitudinal" axis thereof are generally normal to the earth's surface. Of course, in a linear, curved or other nonlinear drill line, which may both enter and exit the earth's surface, the "lower" portion of the drill line, which first extends generally "downwardly" into the earth, first enters the earth's surface at an entry point and, also, first exits the earth's surface at an exit point. In other words, with respect to the "upper" portion, the "lower" portion of the drill line is farthest from the entry point of the drill line at either the bottom/end of the hole or else at the exit point of the drill line.

As employed herein, the term "outwardly" shall expressly include, but not be limited to a direction of an exit portion of a conduit of an impact drill bit which causes working fluid flowing through the conduit to emerge from the interior to the exterior of such bit and effect rotation of the bit, such as, for example, a non-radial direction which is generally opposite from the direction of desired rotation of the bit about the longitudinal axis thereof.

Figure 1:
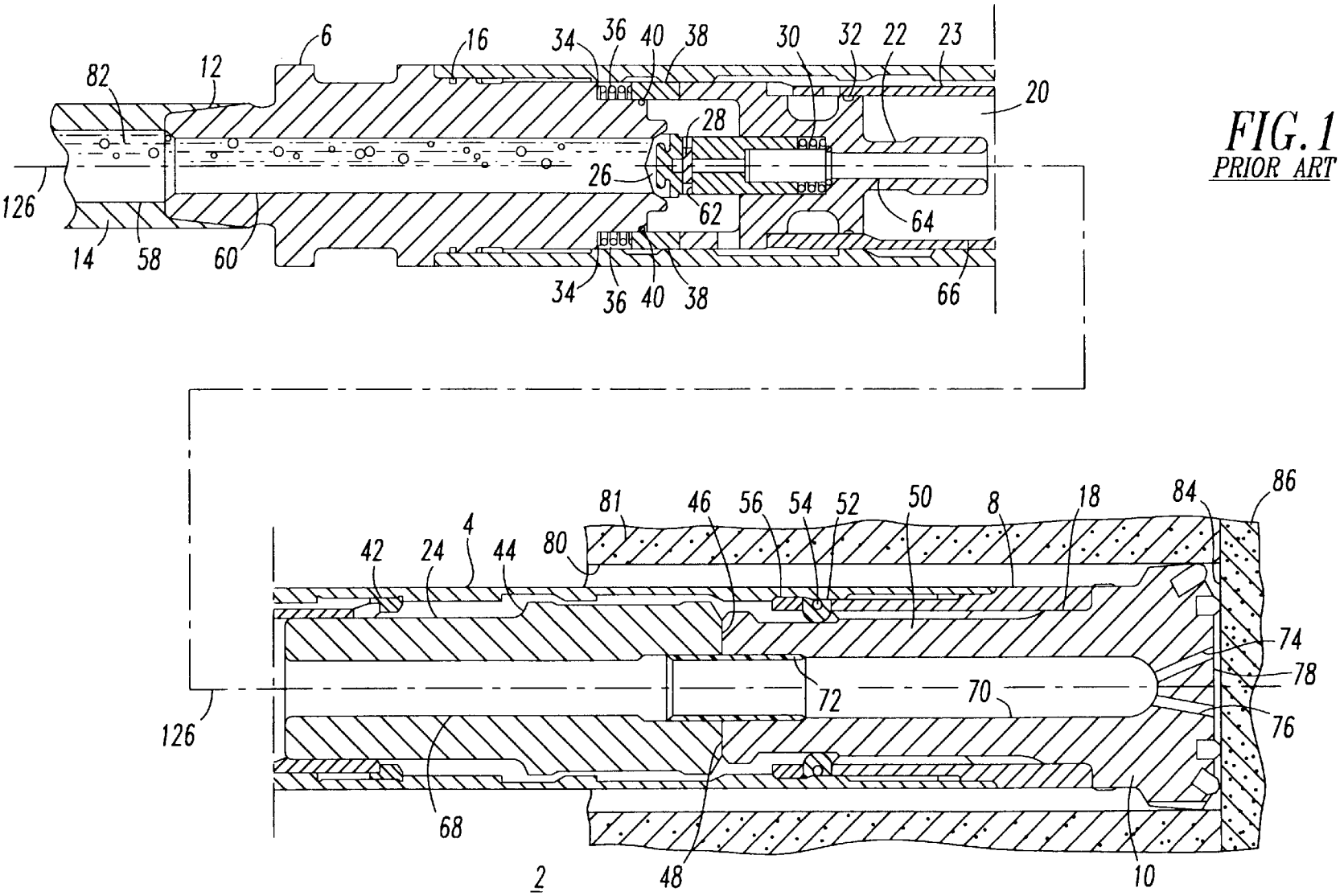
FIG. 1 PRIOR ART
FIG. 1 is a vertical sectional view of a conventional pneumatic percussion hammer drill attached to a drill string.

Referring to FIG. 1, a conventional down-hole pneumatic percussion hammer drill 2 is illustrated. The drill 2 includes an elongated drill housing or casing 4 with a backhead 6 disposed at the upper end (toward the left of FIG. 1), and a chuck 8 with an impact drill bit 10 disposed at the lower end (toward the right of FIG. 1). The backhead 6 has an API pin 12, which is suitably secured to a drill string 14, and also has an o-ring 16, which is disposed between the backhead 6 and the upper portion of the casing 4. The bit 10 has a shank 18 which is splined to the chuck 8. In this manner, the drill string 14, backhead 6, casing 4, chuck 8, and bit 10 may be rotated together as a single unit.

Disposed within the internal chamber 20 of the casing 4 are an air distributor 22, a cylinder 23, a piston 24 and the upper portion of the bit 10. The air distributor 22 includes a check valve 26, a check valve plug 28, a check valve spring 30, and an o-ring 32. The upper portion of the air distributer 22 slidably engages the inner surface of the casing 4. An intermediate portion of the air distributer 22 and the o-ring 32 slidably engage the inner surface of the cylinder 23. Disposed between the backhead 6 and the upper end of the air distributor 22 are a wear spacer 34, a spring 36, and a spacer 38. An o-ring 40 is disposed between the backhead 6 and the spacer 38.

The upper portion of the piston 24 is movable within the lower portion of the cylinder 23. A cylinder stop ring 42 engages (not shown) a shoulder 44 of the piston 24 in order to stop upward movement of the piston 24. On the other hand, with downward movement of the piston 24, the lower surface 46 of the piston 24 engages (as shown in FIG. 1) the upper surface 48 of the bit 10. The upper portion 50 of the bit 10 is secured by a bit retaining ring 52 having an o-ring 54 adjacent the inside surface of the casing 4. The retaining ring 52 is secured against the upper surface of the chuck 8 by a retaining ring 56.

The drill string 14, the backhead 6, the check valve plug 28, the air distributer 22, the cylinder 23, the piston 24, and the bit 10 have conduits 58,60,62,64,66,68,70, respectively, extending therethrough from above the upper end to the lower end of the drill 2. A choke tube 72, made of any suitable material such as teflon, is disposed within the lower portion of the conduit 68 of the piston 24 and the upper portion of the conduit 70 of the bit 10. The bit 10 further includes conduits 74,76 extending from the lower portion of the conduit 70 to an earth impacting surface 78 at the lower end of the drill 2.

During operation, the drill string 14 is rotated by a suitable source of rotational energy (not shown). Also, the drill 2, within a hole 80 in the earth 81, is energized by a working fluid 82, such as compressed gas, by a compressor (not shown) suitably interconnected with the conduit 58 of the drill string 14. During such operation, the piston 24 repetitively engages the bit 10, such as a steel impact drill bit. For example, with each impact, an energy wave travels through the exemplary steel material of the impact drill bit 10 at about the speed of sound in steel (i.e., about 5.0 km/s (3.1 miles/s)). In other words, at the time the piston 24 engages the impact drill bit 10, the earth impacting surface 78 of the bit 10 has not yet received the force of the piston 24. As a further non-limiting example, in a typical 15.2-cm (6-inch) pneumatic percussion drill bit with a 43.2 cm (17 inch) longitudinal axis, it takes about 0.086 ms for the energy wave to travel through the bit 10 to the earth face 84.

The energy wave passes through the piston 24 and the bit 10 to the earth face 84. When tile energy wave reaches the earth impacting surface 78 of the bit 10, some of the energy is absorbed by the earth 86 being crushed. Most of the remainder of the energy reflects back through the bit 10, with a small portion being dissipated in other forms of energy (e.g., sound). When the bit 10 is normal to the earth 81, for example, after the earth 86 is crushed, the bit 10 is momentarily about weightless as the energy is reflected back through the bit 10.

Figure 2:
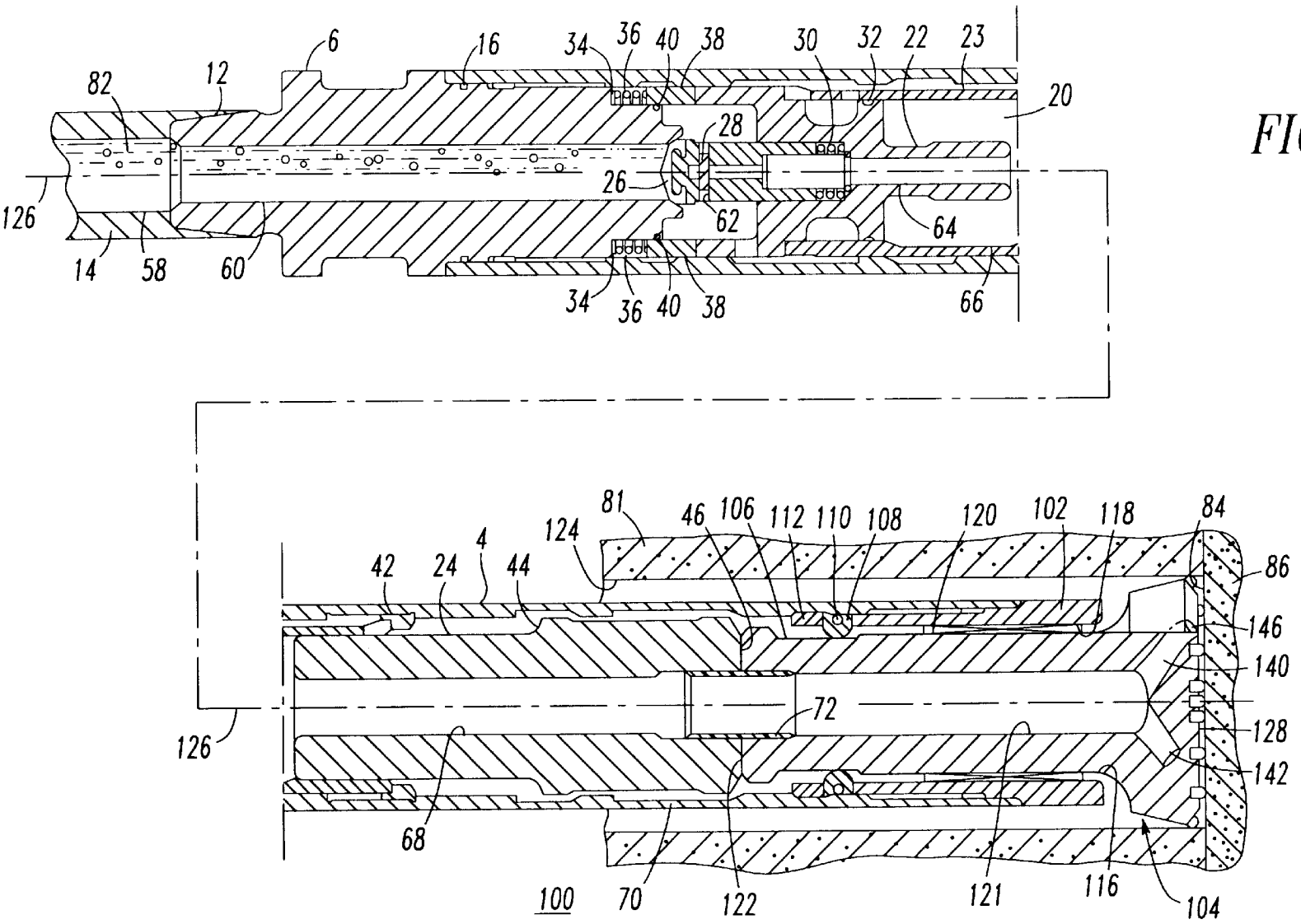
FIG. 2 is a vertical sectional view of an improved pneumatic percussion hammer drill, attached to a drill string, including an improved drill bit in accordance with the invention.

Referring to FIG. 2, an improved down-hole pneumatic percussion hammer drill 100 is illustrated. The drill 100 includes an improved chuck 102 with an improved impact drill 2)t 104 disposed at the lower end (toward the right of FIG. 2). The tipper portion 106 of the bit 104 is rotatably supported by a bit retaining ring 108, such as a pair of C-spacers, having an o-ring 110 adjacent the inside surface of the casing 4. The bit retaining ring 108 is secured against the upper surface of the chuck 102 by a retaining ring 112. The bit 104 also includes a shank 116, which is displaced from the inner bearing surface 118 of the chuck 102, and a bearing 120, which rotatably engages the chuck inner bearing surface 118. The bearing surface 118 rotatably supports the shank 116 of the drill bit 104. In this manner, the bit 104 is rotatable independent from the drill string 14, backhead 6, casing 4, and chuck 102. Preferably, the bit retaining ring 108, which rotatably supports the upper portion 106 of the bit 104, and the bearing 120, which rotatably engages the chuck inner bearing surface 118 and rotatably supports the shank 116 of the bit 104, minimize friction and, thereby, reduce reaction forces between the drill string 14 and the bit 104 caused by friction.

The drill string 14, the backhead 6, the check valve plug 28, the air distributer 22, the cylinder 23, the piston 24, and the bit 104 have conduits 58,60,62,64,66,68,121, respectively, extending therethrough from above the upper end toward the lower end of the drill 100. The choke tube 72 is disposed within the lower portion of the conduit 68 of the piston 24 and the upper portion of the channel or conduit 121 of the bit 104. The operation of the piston 24 was described above in connection with FIG. 1. The exemplary air distributor 22 handles the exemplary working fluid 82 and thereby energizes the piston 24. With downward movement of the piston 24, the lower surface 46 of the piston 24 engages the upper engaging surface 122 of the bit 104.

The exemplary drill 100 is preferably employed to drill a hole 124 in the earth 81. The drill string 14 progressively extends into the hole 124. The drill bit 104 is rotationally coupled to the chuck 102 which is suitably secured to the elongated casing 4. Preferably, the bit 104 is coaxial with the longitudinal axis 126 of the casing 4; is rotatable thereabout; and minimizes any torque applied to the chuck 102, casing 4, or drill string 14.

Figure 3:
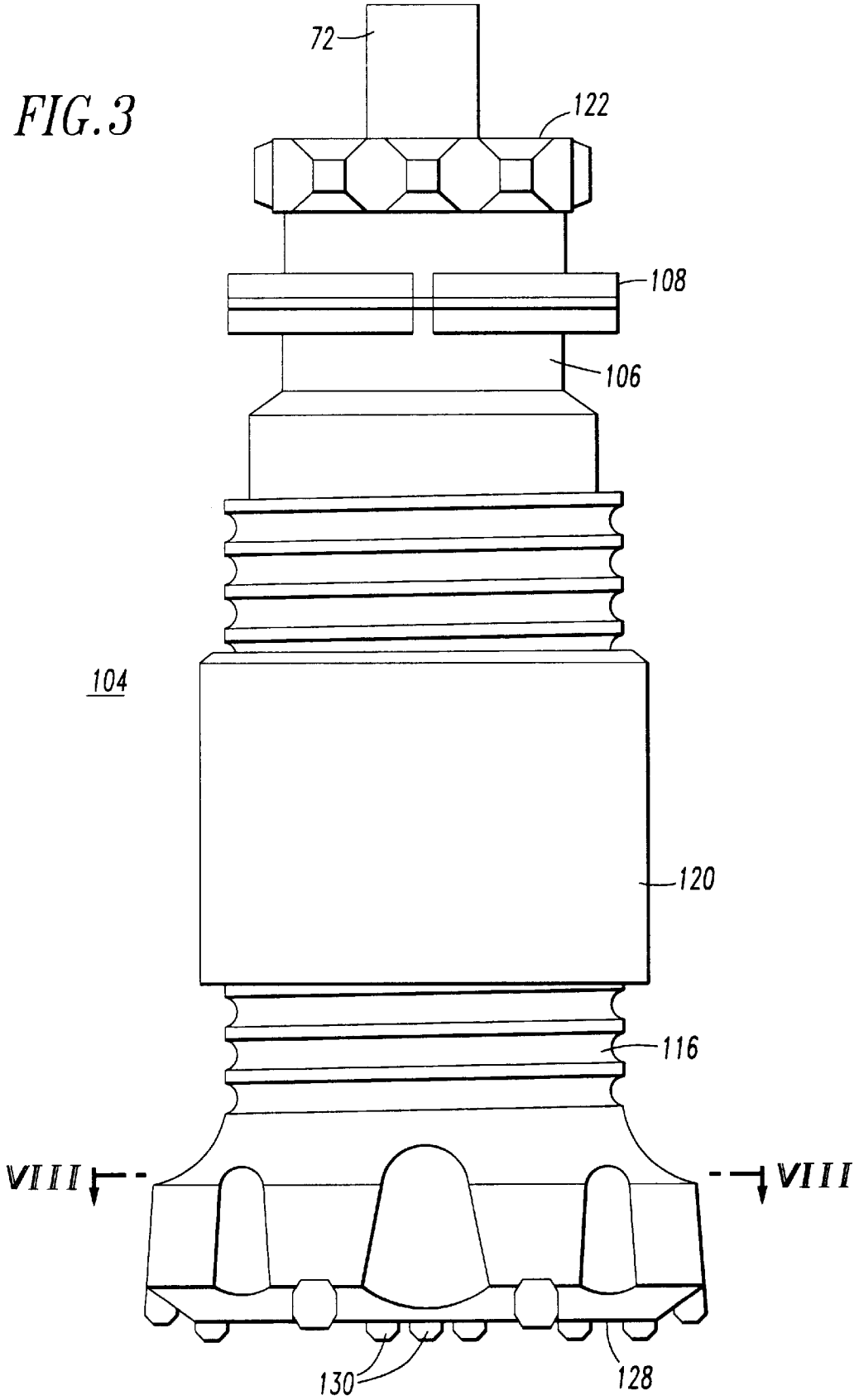
FIG. 3 is a side view of the drill bit of FIG. 2.

Referring to FIG. 3, a side view of the exemplary drill bit 104 and bearing 120 is illustrated. The bit 104 has an earth impacting face or surface 128 at the lower end thereof. The exemplary surface 128 includes a plurality of carbides 130, although the invention is applicable to any type of rotary-impact drill bit face (e.g., drop center, concave, flat face, convex) employing any suitable material for impacting the earth.

Figure 4:
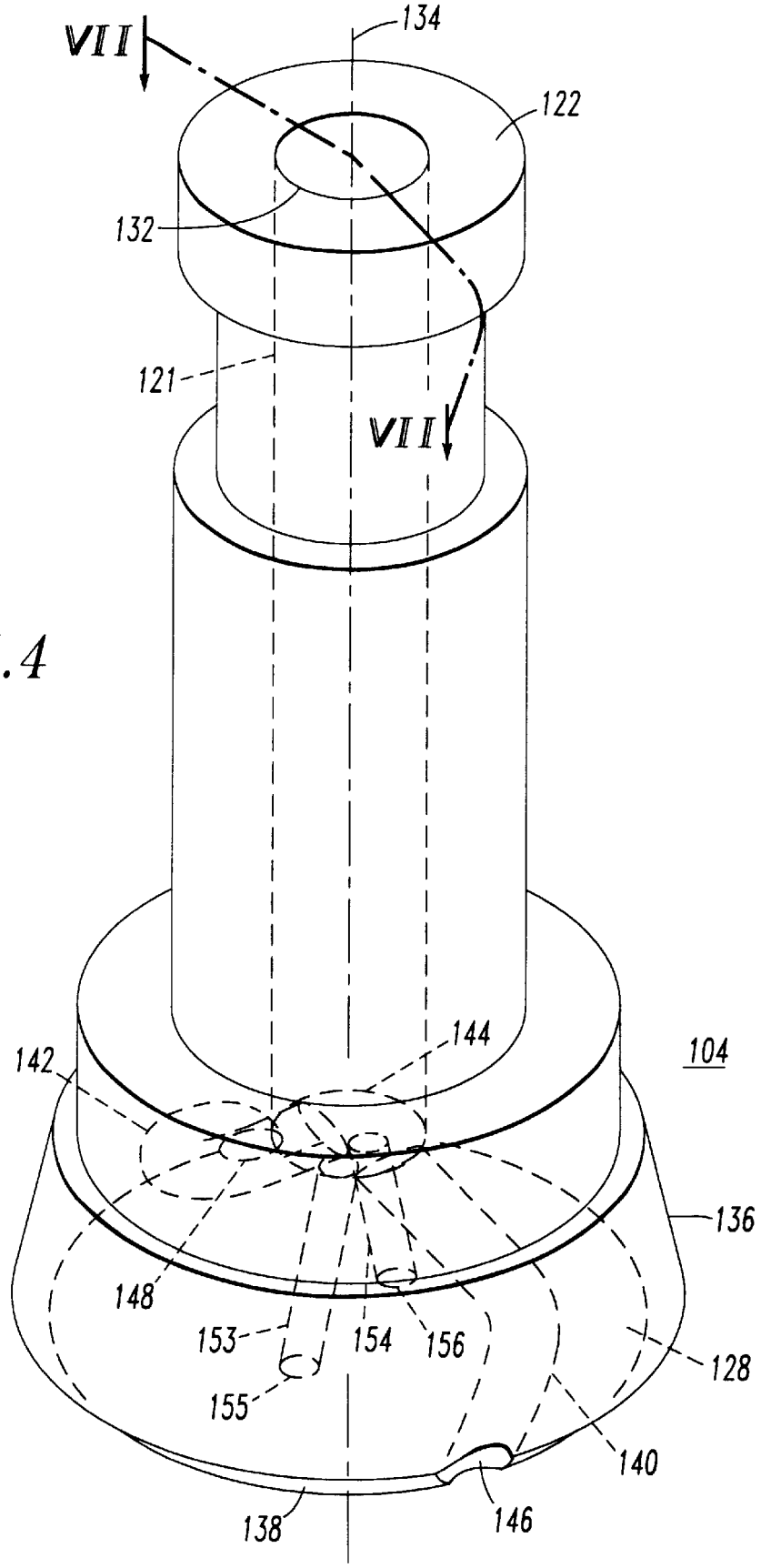
FIG. 4 is a simplified isometric view of the drill bit of FIG. 2.

Referring to FIG. 4, a simplified isometric view of the bit 104 is illustrated. The internal conduit structure of the bit 104 is primarily shown in hidden line drawing. The exemplary channel or conduit 121 extends from an entrance hole 132 at the upper engaging surface 122, partially extends along the longitudinal axis 134 of the bit 104 toward the lower earth impacting surface 128 (shown in hidden line drawing), and stops short of such surface 128.

Figure 5:
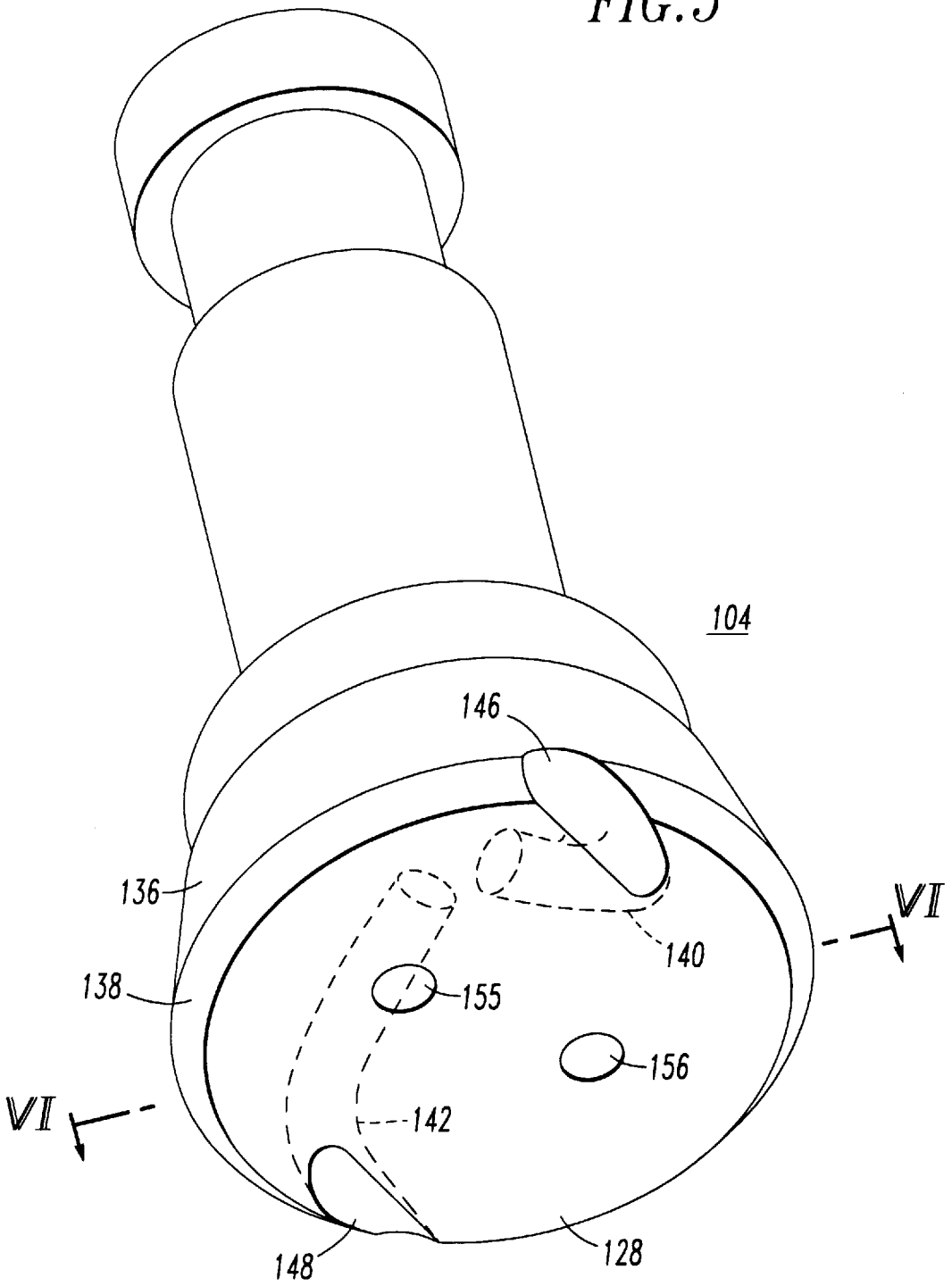
FIG. 5 is another simplified isometric view of the drill bit of FIG. 2.
Figure 6:
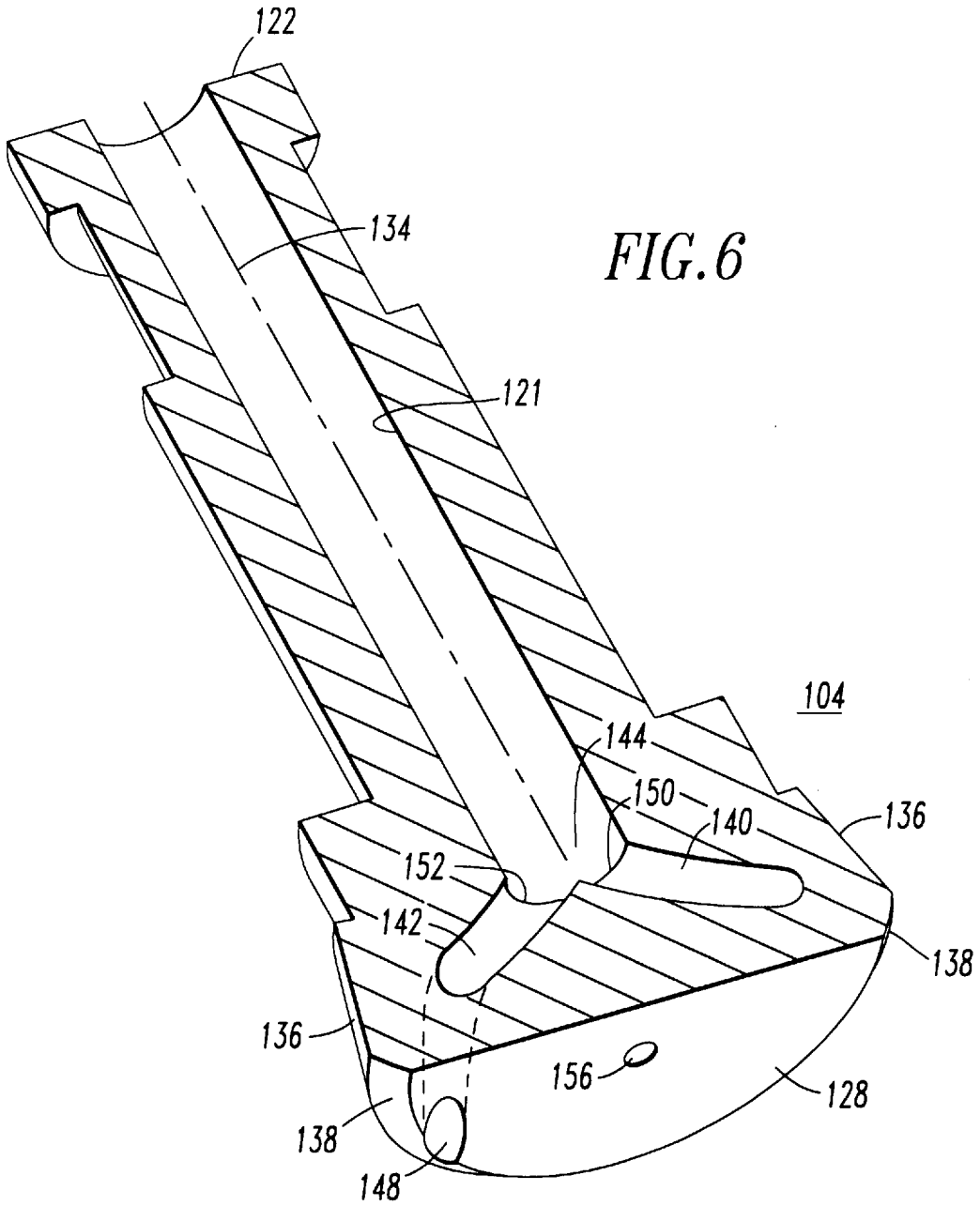
FIG. 6 is a cross sectional isometric view along lines VI—VI of FIG. 5.

Referring to FIGS. 4–6, the bit 104 also has an outer surface 136, and an intermediate surface 138 between the outer surface 136 and the earth impacting surface 128. The exemplary bit 104 further has two nonlinear, arcuate conduits 140,142 (as shown in hidden line drawing in FIG. 4) each of which extends from about the exit 144 (as best shown in FIG. 6) of the conduit 121 to exit portions 146,148, respectively, which are substantially at the earth impacting surface 128 (as best shown in FIG. 5) and partially at the adjacent intermediate surface 138 (as best shown in FIG. 5). The conduits 140,142 have entrances 150,152, respectively (as shown in FIG. 6). The channel or conduit 121 extends from about the engaging surface 122 to about the entrances 150,152. The exemplary conduits 140,142 extend from about the exit 144 of the conduit 121 to the exit portions 146,148, respectively, at about the earth impacting surface 128. The conduit 121 is operatively associated with the conduits 140,142 to permit the flow of the working fluid 82 of FIG. 2 therethrough. The conduits 121,140,142 provide a path of flow of the working fluid 82 from the conduit 68 of the piston 24 and the choke tube 72 of FIG. 2 for delivery to the exit portions 146,148.

Figure 7:
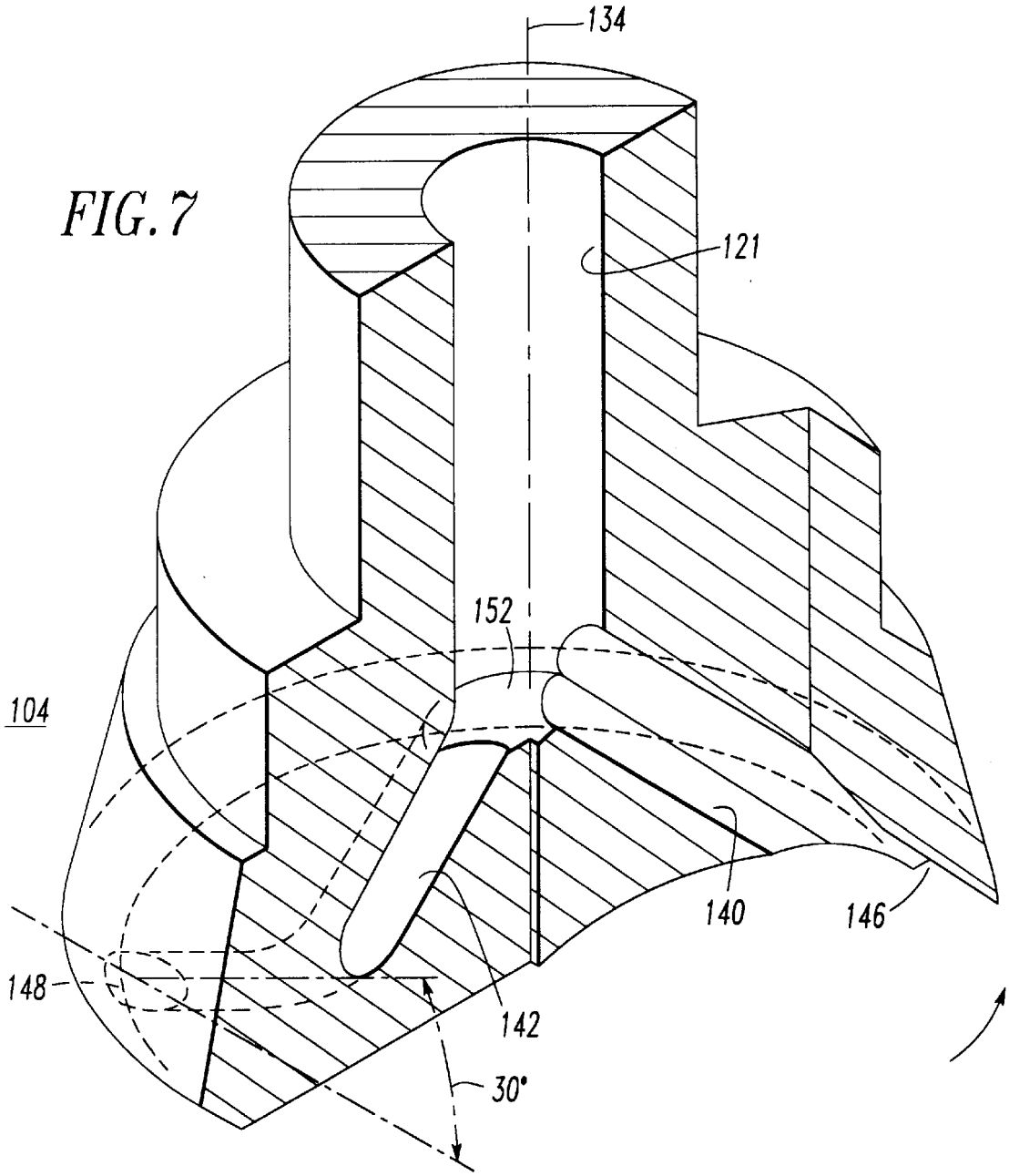
FIG. 7 is a nonlinear cross sectional isometric view generally along lines VII—VII of FIG. 4.
Figure 8:
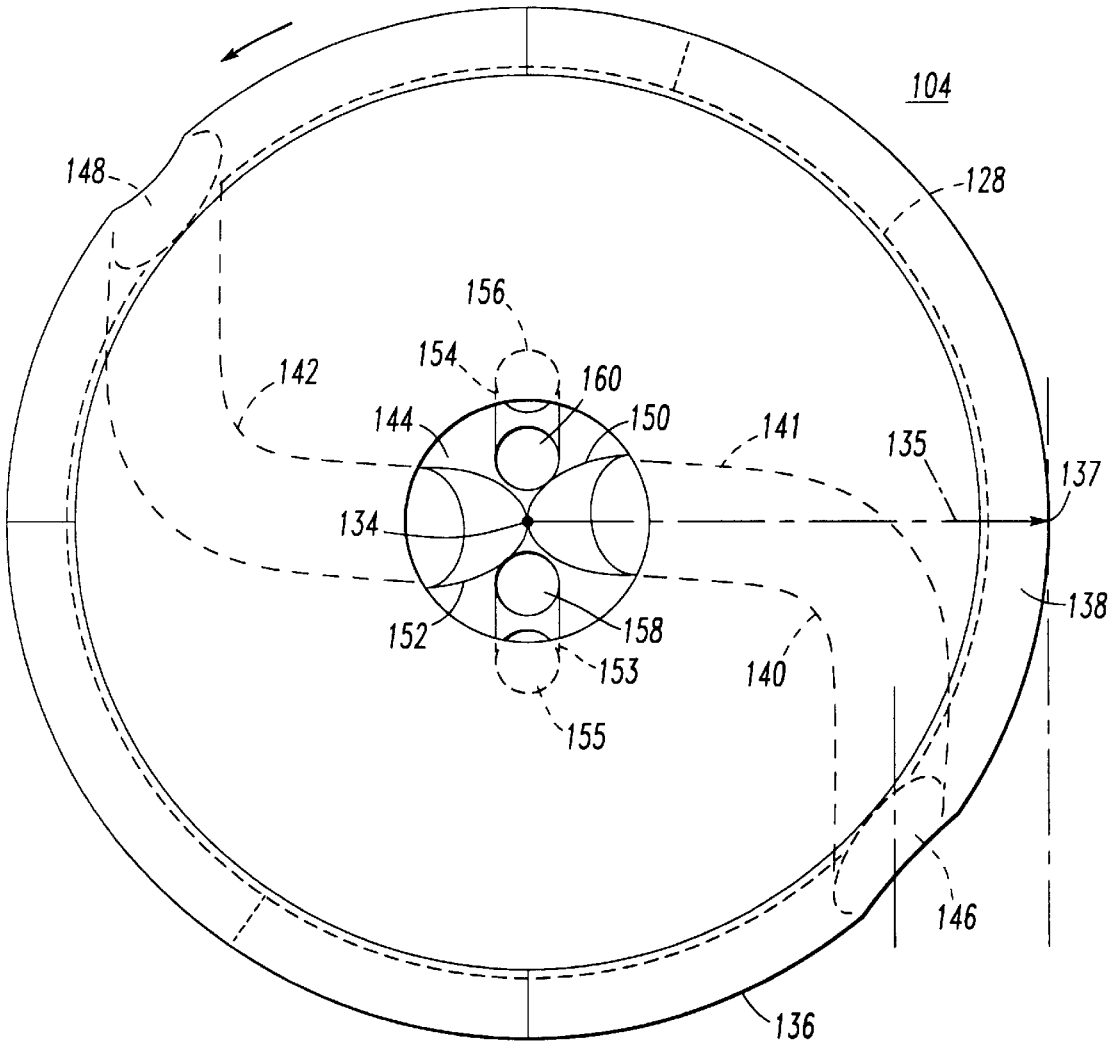
FIG. 8 is a simplified plan view of the cross section defined by lines VIII—VIII of FIG. 3.

Also referring to FIGS. 2, 7 and 8, the exit portions 146,148 are displaced from the longitudinal axis 134 of the bit 104 and extend generally downwardly and outwardly to effect an exemplary counter-clockwise rotation (with respect to FIGS. 7 and 8), it being understood that the exit portion 146 of FIG. 7 has a similar structure to effect such rotation (see FIG. 8), and it further being understood that the invention is applicable to a wide range of displacements of the exit portions 146,148 from the axis 134 as well as a wide range of exit angles of the exit portions 146,148 to effect rotation in either a clockwise or counter-clockwise rotational direction. In this manner, the working fluid 82, which emerges from the exit portions 146,148, effects rotation of the impact drill bit 104 about the longitudinal axis 126 of the casing 4.

Preferably, as shown in FIG. 7, the general axis of each of the exit portions 146,148 of the drill bit 104 is displaced (as shown in hidden line drawing with portion 148) from the longitudinal axis 134 by about 60° and from the general plane of the earth impacting surface 128 (shown in FIG. 6) by about 30°, although a wide range of downward angles are possible. The working fluid 82 emerging from the exemplary exit portions 146,148, effects more rotation about the longitudinal axis 134 than lift of the exemplary impact drill bit 104 off of the earth face 84 of FIG. 2, although the invention is applicable to a wide variety of exit portions which effect more or less rotation and more or less lift.

As best shown in FIG. 8, the conduits 140,142 extend outwardly from the longitudinal axis 134, preferably with a ratio of the length of conduit portion 141 to the length of the radius 135 of the drill bit 104 being about ⅔ as shown with conduit 140. The general axis of each of the exit portions 146,148 is away from the radius 135 and, preferably, is about parallel with respect to a tangent to the outer surface 136 of the drill bit 104 at portion 137 as shown with corresponding exit portion 146, although a wide range of ratios and exit portion angles are possible.

As shown in FIGS. 4–6, the exemplary impact drill bit 104 further includes two flush conduits 153,154 (as shown in hidden line drawing in FIG. 4) extending from about the exit 144 of the channel or conduit 121 to openings 155,156, respectively, at the earth impacting surface 128, although the invention is applicable to drill bits having zero, one, or more flush conduits which exit from any of the conduits 121,140, 142. In the drill bit 104 of FIG. 8, the exit 144 of the conduit 121 of FIG. 2 is illustrated along with the entrances 150, 152,158,160 of the conduits 140,142,153,154, respectively.

Figure 9:
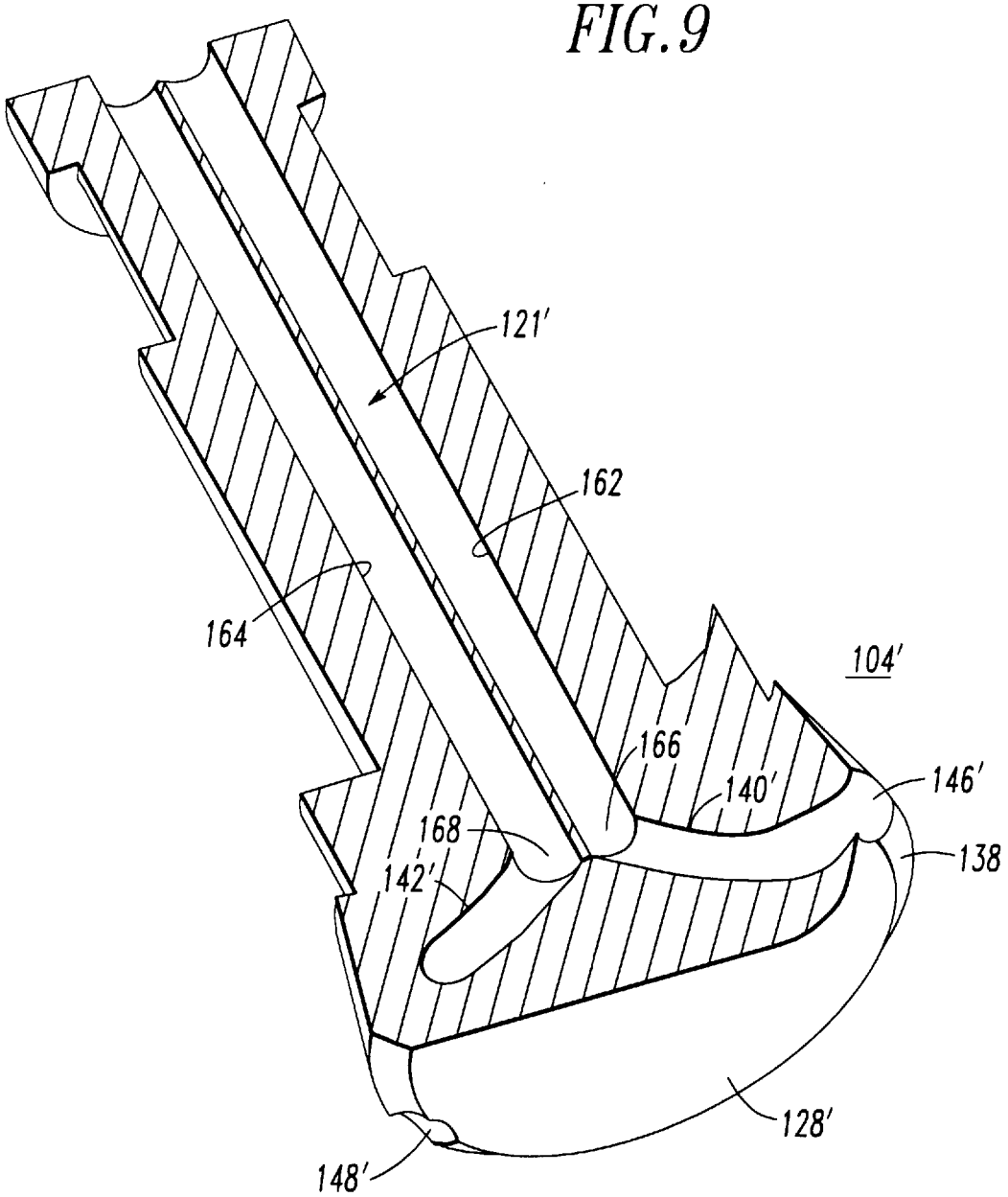
FIG. 9 is a nonlinear vertical sectional view of a drill bit in accordance with an alternative embodiment of the invention.

FIG. 9 illustrates an alternative drill bit 104' having an alternative channel mechanism 121' formed by two separate channels 162,164 having exits 166,168, respectively. In this embodiment, the conduits 140 ', 142' extend from about the exits 166,168 to the exit portions 146 ', 148 ', respectively, at about the earth impacting surface 128 ', although the invention is applicable to any number of channels, and any number of conduits to effect rotation of a drill bit. For example, greater than one channel may be provided each of which supplies less than all of the working fluid 82 of FIG. 2 to less than all of the conduits.

Figure 10:
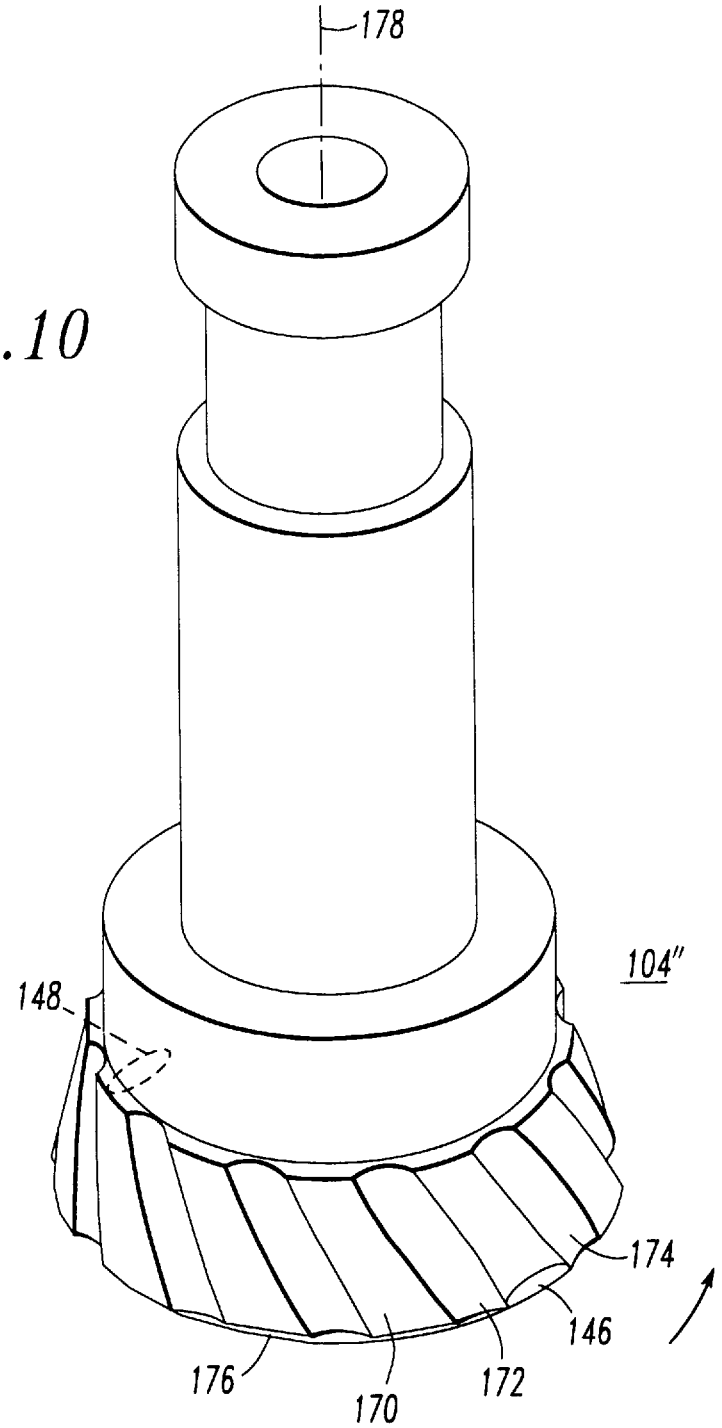
FIG. 10 is an isometric view of a drill bit in accordance with another alternative embodiment of the invention.

FIG. 10 is an isometric view of another alternative drill bit 104" having an outer surface 170 including a plurality of circumferentially spaced, external return passageways 172, 174 for effecting return therethrough of the working fluid 82 of FIG. 2 from the earth impacting surface 176. The exemplary external return passageways 172,174 extend partially circumferentially and generally upwardly, in order that the return of the working fluid 82 effects rotation of the impact drill bit 104" about the longitudinal axis 178, although the invention is applicable to a wide variety of external return passageways which effect rotation of an impact drill bit, such as passageways which extend circumferentially and generally upwardly.

Figure 11:
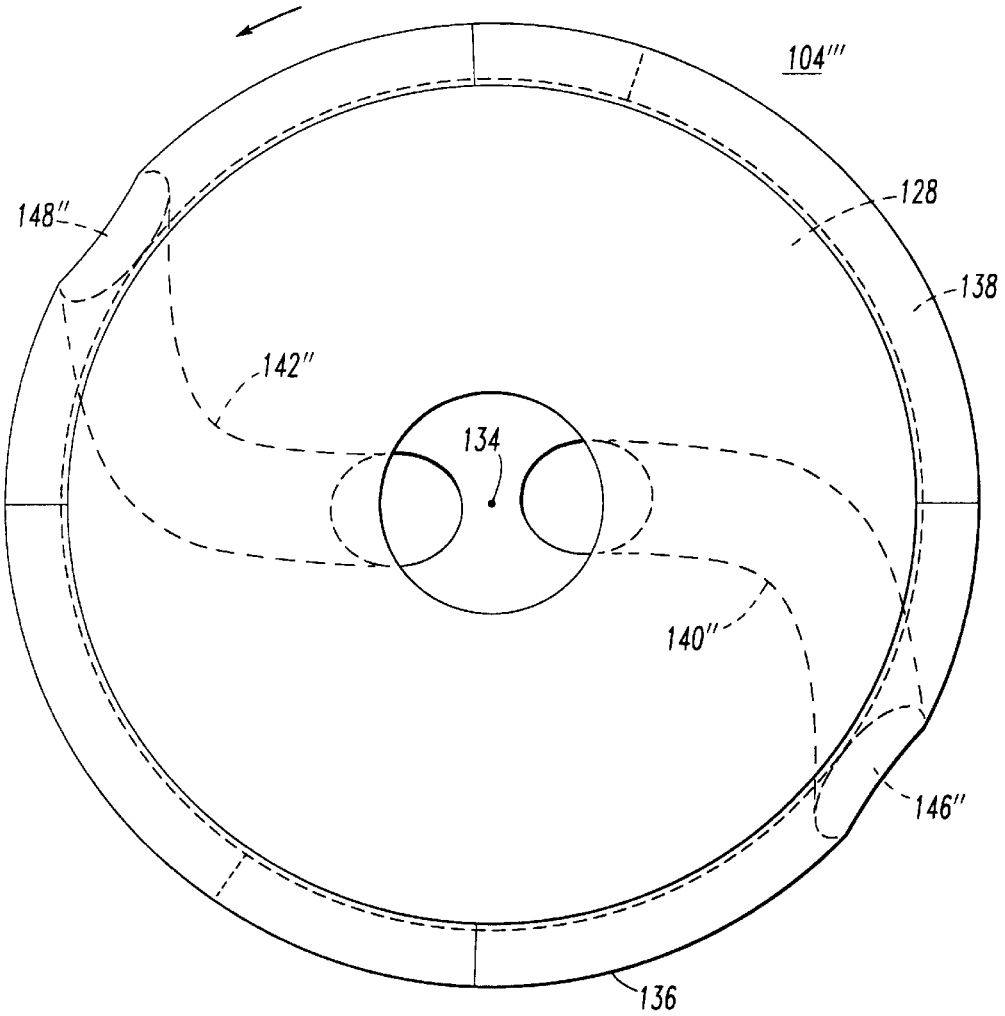
FIG. 11 is a simplified plan view, similar to FIG. 8, of a drill bit in accordance with another alternative embodiment of the invention.

FIG. 11 is a simplified plan view, similar to FIG. 8, of the lower conduit-portion of a drill bit 104"', similar to the drill bit 104, in accordance with another embodiment of the invention. The exit portions 146", 148" are displaced from the longitudinal axis 134 of the bit 104"' and extend generally downwardly and outwardly to effect an exemplary counter-clockwise rotation (with respect to FIG. 11). In this manner, the working fluid 82, which emerges from the exit portions 146", 148", effects rotation of the impact drill bit 104"' about the longitudinal axis 126 of the casing 4 of FIG. 2. The exit portions 146", 148" are substantially at the intermediate surface 138 (as best shown in FIG. 5) and partially at the adjacent surfaces 128,136 (as best shown in FIG. 5).

It will be appreciated that, in general, the preferred embodiment of the invention will result in both the downward supply of the working fluid 82 through the exit portions 146,148 of FIGS. 4 and 10 (as well as the exit portions 146', 148' of FIG. 9 or the exit portions 146", 148" of FIG. 11) and the upward return of the working fluid 82 through the plural external return passageways 172,174 of FIG. 10 contributing to the bit rotation, although the invention is applicable to rotary-percussion drill bits having exit portions at the lower, intermediate or tipper portions of the bit to effect rotation.

The exemplary drill bits 104,104 ', 104", 104"' disclosed herein are preferably rotated at an exemplary rate of about three rotations per minute under the influence of the working fluid 82, such as compressed gas, although the invention is applicable to a wide variety of impact bit rotation rates. Such drill bits provide for a reliable pneumatic percussion drilling apparatus which improves drillhole deflection in hard earth structures such as, for example, hard rock. It is believed that such apparatus requires fewer moving parts, is inherently more reliable, and provides for a greater reduction of the reaction forces between the drill string and drill bit than known prior art devices. In turn, these provide the additional benefits of increased drill accuracy, particularly when steering a drill line; reduced down-time; and lower maintenance costs.

Whereas particular embodiments of the present invention have been described above for purposes of illustration, it will be appreciated by those skilled in the art that numerous variations in the details may be made without departing from the invention as described in the appended claims.

I claim:

1. A rotary-percussion drilling apparatus for drilling a hole in the earth, said apparatus comprising:

drill string means for progressively extending into said hole;

an elongated housing connected to said drill string means, with said elongated housing having a longitudinal axis;

impact drill bit means rotationally coupled to said elongated housing, said impact drill bit means having an engaging surface; an earth impacting surface; channel means having an exit; and a plurality of conduits each of which extends from about the exit of said channel means to an exit portion of said each of said conduits, with said impact drill bit means rotatable about the longitudinal axis of said elongated housing;

piston means within said elongated housing for engaging the engaging surface of said impact drill bit means and forcing the earth impacting surface of said impact drill bit means to impact and penetrate a portion of the earth; and working fluid handling means for energizing said piston means by means of a working fluid, with said channel means and said conduits of said impact drill bit means providing a path of flow of the working fluid from said piston means to the exit portions of said conduits, and the exit portions of said conduits being displaced from the longitudinal axis and extending generally downwardly and outwardly, in order that the working fluid emerging from said exit portions effects rotation of said impact drill bit means about the longitudinal axis of said elongated housing.

2. The apparatus recited in claim 1 wherein the exit portions of said conduits are at about the earth impacting surface; and wherein said impact drill bit means further has an outer surface including a plurality of external return passageways for return therethrough of the working fluid from the earth impacting surface.

3. The apparatus recited in claim 1 wherein said impact drill bit means is coaxial with the longitudinal axis of said elongated housing.

4. The apparatus recited in claim 1 wherein said conduits of said impact drill bit means are nonlinear conduits.

5. The apparatus recited in claim 1 wherein said impact drill bit means further has an outer surface and an intermediate surface between the outer surface and the earth impacting surface; and wherein each of said conduits substantially exits at the intermediate surface of said impact drill bit means.

6. The apparatus recited in claim 5 wherein said conduits of said impact drill bit means are first conduits; and wherein said impact drill bit means further includes a plurality of second conduits extending from about the exit of said channel means to the earth impacting surface of said impact drill bit means.

7. The apparatus recited in claim 1 wherein said impact drill bit means has a longitudinal axis; and wherein said channel means of said impact drill bit means partially extends along the longitudinal axis thereof.

8. The apparatus recited in claim 7 wherein each of said conduits has an entrance; and wherein said channel means extends from about the engaging surface of said impact drill bit means to about the entrance of said conduits.

9. The apparatus recited in claim 7 wherein said conduits of said impact drill bit means are first conduits; and wherein said impact drill bit means further includes at least one second conduit extending from about the exit of said channel means to the earth impacting surface of said impact drill bit means.

10. The apparatus recited in claim 1 wherein said elongated housing includes a chuck having a bearing surface; and wherein said impact drill bit means further has bearing means rotatably engaging the bearing surface of the chuck, with the bearing surface at least partially rotatably supporting said drill bit means.

11. The apparatus recited in claim 1 wherein said impact drill bit means has a radius extending from about the longitudinal axis of said elongated housing; and wherein at least one of said conduits includes an intermediate conduit portion and the exit portion, with the intermediate conduit portion extending from about the exit of said channel means to the exit portion, and with at least the exit portion extending away from said radius.

12. The apparatus recited in claim 11 wherein said impact drill bit means has an outer surface with a tangent thereto, with said radius extending to the outer surface; wherein the exit portion has an axis; and wherein the axis of the exit portion is generally about parallel with respect to the tangent of the outer surface.

13. A rotary-percussion drilling apparatus for drilling a hole in the earth, said apparatus comprising:

drill string means for progressively extending into said hole;

an elongated housing connected to said drill string means, with said elongated housing having a longitudinal axis;

impact drill bit means rotationally coupled to said elongated housing, said impact drill bit means having an engaging surface; an earth impacting surface; channel means having an exit; a plurality of conduits each of which extends from about the exit of said channel means to an exit portion of said each of said conduits; and an outer surface including a plurality of external return passageways, with said impact drill bit means rotatable about the longitudinal axis of said elongated housing;

piston means within said elongated housing for engaging the engaging surface of said impact drill bit means; and working fluid handling means for energizing said piston means by means of a working fluid, with said channel means and said conduits of said impact drill bit means providing a path of flow of the working fluid from said piston means to the exit portions of said conduits, and the exit portions of said conduits being displaced from the longitudinal axis and extending generally downwardly and outwardly, in order that the working fluid emerging from said exit portions effects rotation of said impact drill bit means about the longitudinal axis of said elongated housing, said exit portions of said conduits being at about the earth impacting surface, with said external return passageways for return therethrough of the working fluid from the earth impacting surface, and with said external return passageways extending at least partially circumferentially and generally upwardly, in order that the return of the working fluid effects rotation of said impact drill bit means about the longitudinal axis of said elongated housing.

14. An impact drill bit for use with a rotary-percussion drilling apparatus for drilling a hole in the earth; said apparatus including drill string means for progressively extending into said hole, an elongated housing having a longitudinal axis and being connected to said drill string means, piston means within said elongated housing for engaging said impact drill bit, and means for energizing said piston means by means of a working fluid, comprising:

said impact drill bit including an engaging surface; an earth impacting surface; channel means having an exit; and a plurality of conduits each of which extends from about the exit of said channel means to an exit portion of said each of said conduits, with said channel means and said conduits of said impact drill bit providing a path of flow of the working fluid from said piston means to the exit portions of said conduits, said piston means forcing said earth impacting surface to impact and penetrate a portion of the earth; and means for rotationally coupling said impact drill bit to said elongated housing, with said impact drill bit rotatable about the longitudinal axis of said elongated housing, and the exit portions of said conduits being displaced from the longitudinal axis and extending generally downwardly and outwardly, in order that the working fluid emerging from said exit portions effects rotation of said impact drill bit about the longitudinal axis of said elongated housing.

15. The impact drill bit recited in claim 14 wherein said channel means is a single conduit.

16. The impact drill bit recited in claim 14 wherein said channel means is a plurality of channels each of which has an exit; and wherein each of said conduits extends from about a corresponding exit of one of said channels to the exit portion of said each of said conduits.

17. The impact drill bit recited in claim 14 wherein the exit portions of said conduits are at about the earth impacting surface; and wherein said impact drill bit further includes an outer surface having a plurality of external return passageways for return therethrough of the working fluid from the earth impacting surface.

18. The impact drill bit recited in claim 14 wherein said impact drill bit has a radius extending from about the longitudinal axis of said elongated housing; and wherein at least one of said conduits includes an intermediate conduit portion and the exit portion, with the intermediate conduit portion extending from about the exit of said channel means to the exit portion, and with at least the exit portion extending away from said radius.

19. The apparatus recited in claim 18 wherein said impact drill bit has an outer surface with a tangent thereto, with said radius extending to the outer surface; wherein the exit portion has an axis; and wherein the axis of the exit portion is generally about parallel with respect to the tangent of the outer surface.

20. An impact drill bit for use with a rotary-percussion drilling apparatus for drilling a hole in the earth; said apparatus including drill string means for progressively extending into said hole, an elongated housing having a longitudinal axis and being connected to said drill string means, piston means within said elongated housing for engaging said impact drill bit, and means for energizing said piston means by means of a working fluid, comprising:

said impact drill bit including an engaging surface; an earth impacting surface; channel means having an exit; a plurality of conduits each of which extends from about the exit of said channel means to an exit portion of said each of said conduits; and an outer surface having a plurality of external return passageways, with said channel means and said conduits of said impact drill bit providing a path of flow of the working fluid from said piston means to the exit portions of said conduits; and means for rotationally coupling said impact drill bit to said elongated housing, with said impact drill bit rotatable about the longitudinal axis of said elongated housing, and the exit portions of said conduits being displaced from the longitudinal axis and extending generally downwardly and outwardly, in order that the working fluid emerging from said exit portions effects rotation of said impact drill bit about the longitudinal axis of said elongated housing, said exit portions of said conduits being at about the earth impacting surface, with said external return passageways for return therethrough of the working fluid from the earth impacting surface, and with said external return passageways extending at least partially circumferentially and generally upwardly, in order that the return of the working fluid effects rotation of said impact drill bit about the longitudinal axis of said elongated housing.

21. A method for drilling a hole in the earth, said method comprising the steps of:

progressively extending a drill string into said hole;

employing an elongated housing having a longitudinal axis;

connecting said elongated housing to said drill string;

employing an impact drill bit having an engaging surface, an earth impacting surface, channel means having an exit, and a plurality of conduits;

rotationally coupling said impact drill bit to said elongated housing;

extending each of said conduits from about the exit of said channel means to an exit portion of said each of said conduits, with the exit portion of said each of said conduits being displaced from the longitudinal axis of said elongated housing;

energizing piston means by means of a working fluid and engaging the engaging surface of said impact drill bit with said piston means and forcing the earth impacting surface of said impact drill bit means to impact and penetrate a portion of the earth;

providing a path of flow of the working fluid from said piston means to the exit portions of said conduits; and delivering the working fluid outwardly through the exit portions of said conduits in a generally downward direction, in order to cause the working fluid to emerge from said exit portions to effect rotation of said impact drill bit means about the longitudinal axis of said elongated housing.

22. The method of claim 21 further comprising the step of:

effecting return of the working fluid through a plurality of external return passageways disposed on an outer surface of said impact drill bit means.

23. A method for drilling a hole in the earth, said method comprising the steps of:

progressively extending a drill string into said hole;

employing an elongated housing having a longitudinal axis;

connecting said elongated housing to said drill string;

employing an impact drill bit having an engaging surface, an earth impacting surface, channel means having an exit, and a plurality of conduits;

rotationally coupling said impact drill bit to said elongated housing;

extending each of said conduits from about the exit of said channel means to an exit portion of said each of said conduits, with the exit portion of said each of said conduits being displaced from the longitudinal axis of said elongated housing;

energizing piston means by means of a working fluid and engaging the engaging surface of said impact drill bit with said piston means;

providing a path of flow of the working fluid from said piston means to the exit portions of said conduits;

delivering the working fluid outwardly through the exit portions of said conduits in a generally downward direction, in order to cause the working fluid to emerge from said exit portions to effect rotation of said impact drill bit means about the longitudinal axis of said elongated housing;

effecting return of the working fluid through a plurality of external return passageways disposed on an outer surface of said impact drill bit means;

extending the external return passageways at least partially circumferentially and generally upwardly; and effecting the rotation of said impact drill bit means about the longitudinal axis of said elongated housing with the return of the working fluid therethrough.

24. The method of claim 23 further comprising the steps of:

employing said conduits as a plurality of first conduits; and employing a plurality of second conduits extending from about the exit of said channel means to the earth impacting surface of said impact drill bit.

* * * * *

UNITED STATES PATENT AND TRADEMARK OFFICE

CERTIFICATE OF CORRECTION

PATENT NO. : 5,803,187
DATED : September 8, 1998
INVENTOR(S) : BROOKS H. JAVINS

It is certified that error appears in the above-indentified patent and that said Letters Patent is hereby corrected as shown below:

Column 7, line 7, "tile" should be --the--.

Column 7, line 19, "2)t" should be --bit--.

Column 7, line 20, "tipper" should be --upper--.

Column 9, line 59, "tipper" should be --upper--.

Signed and Sealed this

Twenty-second Day of June, 1999

*Attest:*

Q. TODD DICKINSON

*Attesting Officer*

*Acting Commissioner of Patents and Trademarks*